United States Patent [19]

Rudick et al.

[11] Patent Number: 4,752,018

[45] Date of Patent: Jun. 21, 1988

[54] MICRO-GRAVITY PRE-MIX PACKAGE

[75] Inventors: Arthur G. Rudick, Marietta; William S. Credle, Jr.; Bradley P. Baker, both of Stone Mountain, all of Ga.

[73] Assignee: The Coca-Cola Company, Atlanta, Ga.

[21] Appl. No.: 724,155

[22] Filed: Apr. 17, 1985

[51] Int. Cl.[4] ..... B65D 35/28; B65D 83/14

[52] U.S. Cl. ..... 222/1; 222/95; 222/153; 222/386.5; 222/564; 251/121; 251/246

[58] Field of Search ..... 222/92, 95, 386.5, 1, 222/399, 394, 564, 510, 464, 153, 562, 402.11; 251/121, 246, 241; 138/46

[56] References Cited

U.S. PATENT DOCUMENTS

| | | | |
|---|---|---|---|
| 1,125,402 | 1/1915 | Ruysdael | 222/562 X |
| 2,194,658 | 3/1940 | Hirst | 222/92 |
| 2,646,192 | 7/1953 | Gronemeyer | 222/402.11 |
| 2,671,578 | 3/1954 | McBean | 222/386.5 X |
| 2,829,801 | 4/1958 | Ayres | 222/402.11 X |
| 3,227,308 | 1/1966 | Frankenberg | 222/95 X |
| 3,233,779 | 2/1966 | Cornelius | 222/52 |
| 3,245,582 | 4/1966 | Roth et al. | 222/386.5 X |
| 3,273,760 | 9/1966 | Frankenberg | 222/95 X |
| 3,317,090 | 5/1967 | Meshberg | 222/386.5 |
| 3,365,105 | 1/1968 | Krizka | 222/95 X |
| 3,905,517 | 9/1975 | Friedrich et al. | 222/95 |
| 3,979,025 | 9/1976 | Friedrich et al. | 222/95 |
| 4,039,103 | 8/1977 | Juillet | 222/95 |
| 4,095,724 | 6/1978 | Perusco | 222/95 |
| 4,148,416 | 4/1979 | Gunn-Smith | 222/564 |
| 4,159,789 | 7/1979 | Stoody | 222/386.5 X |
| 4,264,019 | 4/1981 | Roberts et al. | 222/95 |

FOREIGN PATENT DOCUMENTS

| | | | |
|---|---|---|---|
| 2001711 | 7/1971 | Fed. Rep. of Germany | 222/95 |
| 1255159 | 1/1961 | France | 222/95 |

*Primary Examiner*—Joseph J. Rolla
*Assistant Examiner*—Edward S. Ammeen
*Attorney, Agent, or Firm*—Birch, Stewart, Kolasch & Birch

[57] ABSTRACT

A package for dispensing a carbonated beverage pre-mix at a controlled flow rate in the micro-gravity conditions of outer space comprising a rigid outer container, a collapsible bag in the container, and an adjustable flow rate control valve. Positive pressure is applied to the collapsible container by $CO_2$ gas in the container surrounding the bag to assist the dispensing of the pre-mix therefrom. The pre-mix is dispensed from a spout, directly into an astronaut's mouth upon actuation of a lever disposed on the top of the package.

11 Claims, 4 Drawing Sheets

MICRO-GRAVITY PRE-MIX PACKAGE

BACKGROUND OF THE INVENTION

The present invention relates to a package for dispensing a carbonated beverage pre-mix at a controlled rate of flow directly into a consumer's mouth in the micro-gravity conditions of outer space. More specifically, the present invention relates to a collapsible container including a variable flow rate control passage therein which maintains a substantially constant flow of carbonated beverage pre-mix from the container to the consumer's mouth.

It is known that under zero or micro-gravity conditions of outer space, that beverages cannot be poured from a vessel directly into a consumer's mouth. They must be forced out of the vessels or packages, under pressure, directly into the mouth of the consumer or astronaut. For still beverages and water, the astronaut can suck the liquid from a collapsible container through a straw.

Furthermore, the container utilized for dispensing a food or beverage must be of a collapsible volume type in order to preclude the creation of an air space or pocket within the container, the location of which cannot be controlled due to the substantially zero gravity conditions.

Examples of food dispensing containers of the type referred to are illustrated in U.S. Pat. Nos. 3,227,308 and 3,273,760, both to Frankenberg.

While the food dispensing containers of Frankenberg are suitable for dispensing food and some liquids, they would not be suitable for dispensing a carbonated beverage pre-mix in outer space under the micro-gravity conditions that exist.

SUMMARY OF THE INVENTION

Accordingly, it is a primary object of the present invention to provide a package for dispensing a carbonated beverage pre-mix directly into a consumer's mouth in the zero or micro-gravity conditions of outer space at a substantially constant rate of flow which will be comfortable to the consumer of the beverage.

It is a further object of the present invention to provide a micro-gravity pre-mix package suitable for use in outer space which will maintain substantially constant the carbonation level (the amount of $CO_2$ in solution) of a pre-mix throughout the entire dispensing operation of the package from a full to a substantially empty condition.

It is another object of the present invention to provide a micro-gravity pre-mix package for use in outer space, including safety features in connection with the accidental actuation of the package.

These and other objects of the present invention are fulfilled by providing a package for dispensing a carbonated beverage pre-mix at a controlled rate of flow directly into a consumer's mouth in the micro-gravity conditions of outer space, comprising:

a rigid container; a collapsible bag disposed within the rigid container, the bag containing the carbonated beverage pre-mix; a drinking spout for dispensing the carbonated beverage directly into the consumer's mouth; a valve associated with the spout for starting or stopping the flow of carbonated beverage therethrough; a valve actuator for opening or closing the valve to start or stop the flow, respectively; a propellant gas disposed in the rigid outer container around the collapsible bag for compressing the bag and forcing the carbonated pre-mix to flow through the spout when the valve is open, the propellant gas having a sufficient initial pressure to ensure that the carbonation of the carbonated beverage pre-mix remains in solution throughout the dispensing period of the package; and a flow-rate control device for maintaining a substantially constant rate of flow of the carbonated beverage pre-mix from the bag through the drinking spout.

The present invention also provides a unique method of dispensing a carbonated beverage pre-mix in the micro-gravity conditions of outer space utilizing the above-described package structure.

The package of the present invention also includes safety features such as a removable safety cap over the drinking spout and a safety lock associated with the valve actuator, to preclude accidental dispensing of the carbonated beverage pre-mix.

In a preferred embodiment, the propellant gas utilized is carbon dioxide because it is totally compatible with the carbon dioxide in solution within the carbonated beverage pre-mix in the contiguous, collapsible plastic bag.

The flow-rate control means of the present invention in a preferred embodiment includes a tubular housing with a cylindrical top portion, and a cone-shaped bottom portion, and a complementary-shaped or bullet-shaped flow control element within the tubular housing. The space between the inner sidewalls of the tubular housing and the outer sidewalls of the flow control element provide a variable sized passage for the flow of carbonated beverage pre-mix to the drinking spout. A spring is provided for spacing the flow control element from the bottom of the tubular housing so that during filling of the can, the cone-shaped bottom portion of the flow control element will not jam against the bottom of the tubular housing. The position of the flow control element and thus the size of the passage is manually adjustable to provide a predetermined flow rate. There will be only a slight drop in flow rate as propellant pressure decreases, as the can contents are dispensed from a full to an empty condition.

BRIEF DESCRIPTION OF THE DRAWINGS

The objects of the present invention and the attendant advantages thereof will become more readily apparent with reference to the drawings, wherein like reference numerals refer to like parts, the drawing figures illustrating substantially the following.

DETAILED DESCRIPTION OF THE PREFERRED EMBODIMENT

Figure 1:
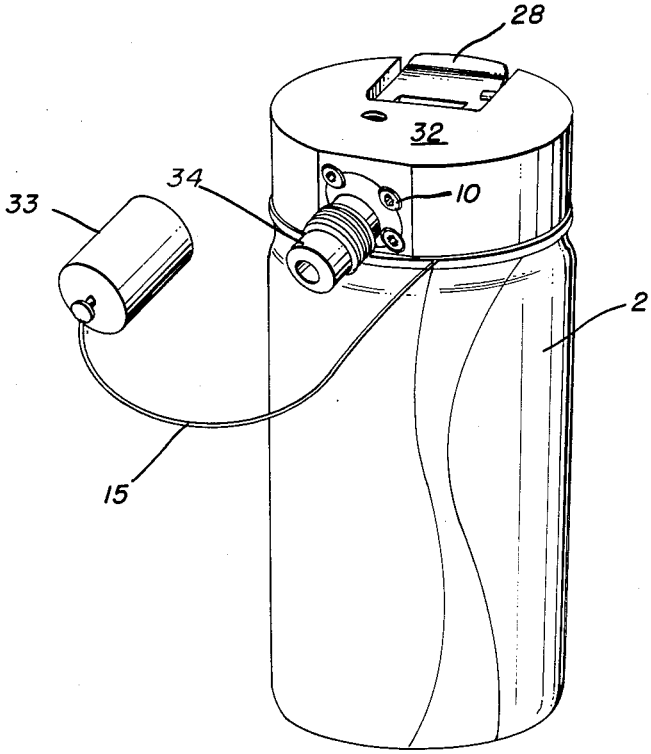
FIG. 1 is a front perspective view illustrating the micro-gravity pre-mix package of the present invention from the drinking spout side with the safety cap removed.
Figure 2:
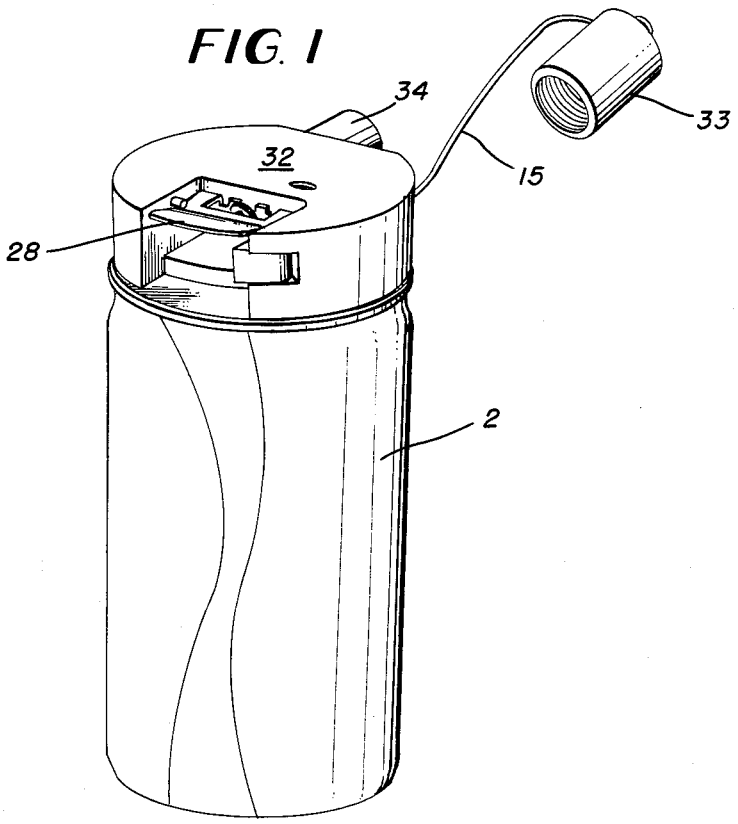
FIG. 2 is a rear perspective view of the pre-mix package of FIG. 1, illustrating the valve-actuating lever on the top of the package.

Referring to FIGS. 1 and 2, there is illustrated in perspective a micro-gravity pre-mix package according to the present invention, including an outer rigid container 2, such as a conventional metal beverage can. Can 2 may also be fabricated from a rigid, durable plastic material if desired. Disposed on the top of container 2 is a valve assembly according to the present invention, including a main body 32, a drinking spout or nozzle 34 secured to the body 32 by means of screws 10, and a valve-actuating lever 28, to be described further hereinafter. Also illustrated in FIGS. 1 and 2 is a safety cap 33 which may be screwed over the drinking spout to preclude the accidental dispensing of carbonated beverage. This safety cap 33 may be secured to the main body 32 of the valve assembly by an appropriate cord 15, as indicated. A strip of "Velcro" may be provided on can 2 to permit support of the can within the spaceship.

Figure 3:
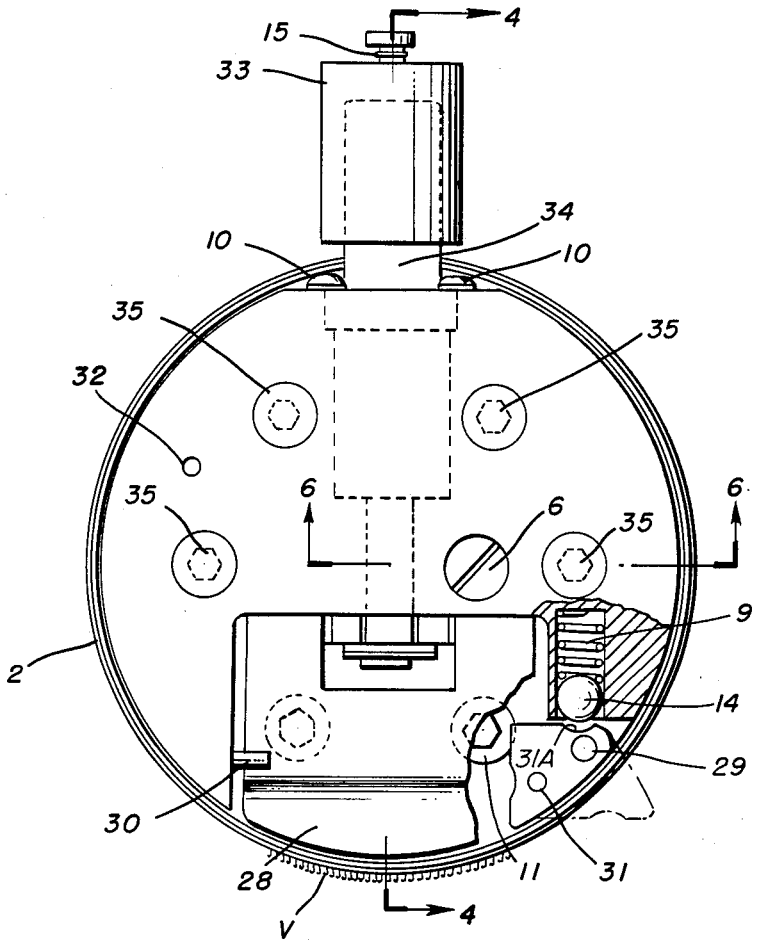
FIG. 3 is a top plan view of the micro-gravity pre-mix package of FIGS. 1 and 2.

FIG. 3 is a top plan view of the package of FIGS. 1 and 2 with a section removed in order to illustrate the operation of a safety lock 31 associated with the valve-actuating lever 28. As illustrated, lock 31 in the solid line position of FIG. 3 is disposed beneath actuating lever 28, which precludes lever 28 from being depressed. Lock 31 is pivotable about a pivot pin 29 and has a notch 31A on the back side therefor for receiving a ball detent 14 which is normally biased into the notch 31A by a spring 9. To unlock the lever 28, lock 31 is pushed to the position illustated in dotted lines of FIG. 3.

Figure 7B:
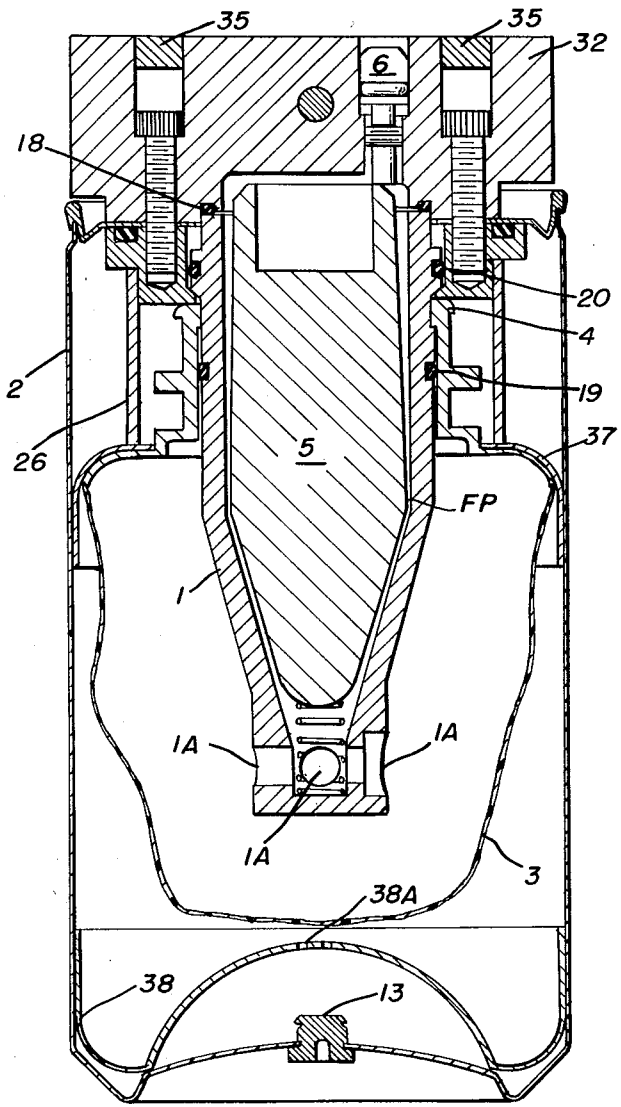
FIG. 7B is a side elevational view, taken along line 4—4 of FIG. 3, showing the flow-rate control device of the present invention, manually adjusted to provide a high rate of flow of beverage therethrough.
Figure 7A:
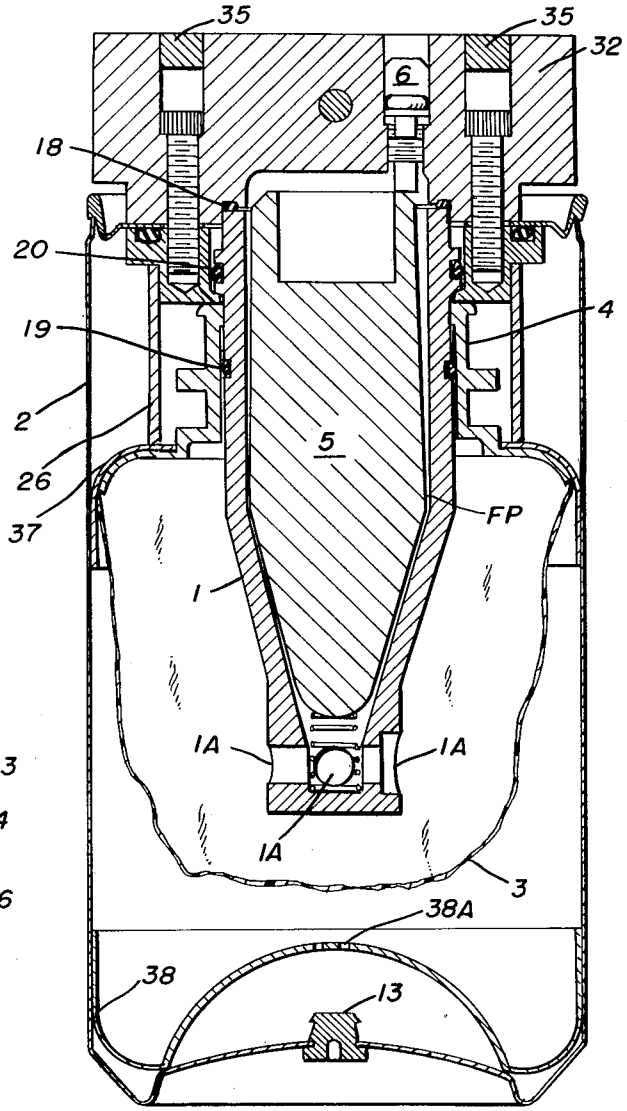
FIG. 7A is a side elevational, sectional view along line 4—4 of FIG. 3, illustrating the flow-rate control device of the present invention manually adjusted to provide a low rate of beverage flow.

The top plan view of FIG. 3 also illustrates a plurality of cosmetic plugs 35 disposed over retaining screws for securing the main body of the valve assembly 32 to the top of the beverage can 2. FIG. 3 also shows in further detail the further provision of a safety cap tether 15 which corresponds to the cord or tether illustrated in FIGS. 1 and 2. FIG. 3 further illustrates, in to plan view, a manually adjustable screw 6 which adjusts the position of the bullet-shaped flow control element in the flow-rate control device of the present invention to different initial positions, to achieve low or high flow rates, as illustrated in FIGS. 7A and 7B, to be discussed hereinafter.

Figure 4:
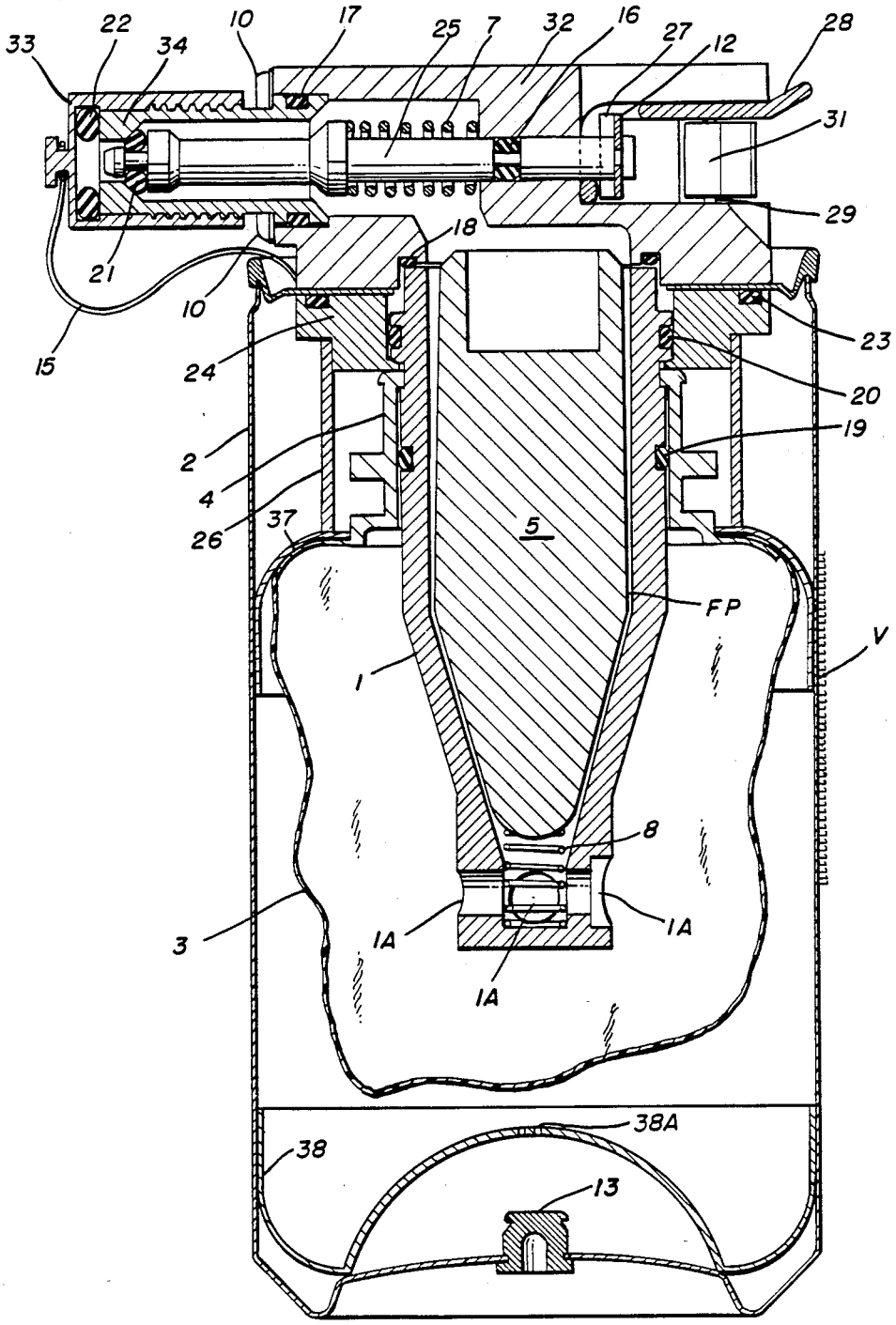
FIG. 4 is a side elevational view in cross-section along line 4—4 of FIG. 3, showing the dispensing valve and associated actuating lever thereof in a closed or unactuated condition.

Referring to FIG. 4, which is a side-elevational view in section of the micro-gravity package of the present invention, there is illustrated the interior details of the package including a flexible plastic bag 3 with a plastic molded spout. The bag may be fabricated from polyethylene, metalized polyester or the like, which contains the carbonated beverage pre-mix to be dispensed. In FIG. 4, the collapsible bag 3 is substantially full. Surrounding the collapsible bag 3 in the space between the outside thereof and the inner walls of the rigid outer container 2, is pressurized carbon dioxide gas which has been introduced through a plug 13 in the bottom of container 2. The pressure of this carbon dioxide gas must be sufficiently high so that the carbonation of the pre-mix within bag 3 is maintained throughout the period of dispensing of the same. That is, the initial pressure of the $CO_2$ gas surrounding bag 3 is chosen so that the pre-mix will maintain $CO_2$ in solution from a "full" condition of the bag 3 to a substantially "empty" condition. Accordingly, the quality of the carbonated beverage is maintained from start to finish. The valve assembly of the present invention is secured to the top of the package through an opening in the top of container 2 by a retainer 24. An O-ring seal 23 is provided between retainer 24 and the inside wall of the top of container 2. Retainer 24 also supports the outer, tubular housing 1 of the flow-rate control device of the present invention in a position extending to the interior of collapsible bag 3. The bottom end of tubular housing 1 is provided with inlet openings 1A for accommodating the flow of the carbonated beverage pre-mix into the tubular housing 1. A complementary-shaped flow control element 5 is disposed within tubular housing 1. In a preferred embodiment, this flow control element is bullet-shaped, as illustrated, having an upper cylindrical portion and a lower cone-shaped portion. The bullet-shaped flow control element 5 is supported in spaced proximity to the inner walls of tubular housing 1 by a coil spring 8 sandwiched between the bottom of the flow control element and the bottom of the complementary-shaped tubular housing. This spring 8 precludes movement of the flow control element 5 downwardly to prevent the flow passage FP between the outer sidewalls of flow control element 5 and the inner sidewalls of the tubular housing 1 from closing when the container is being filled. The size of passage FP is manually adjustable by a screw 6 (FIG. 6) to a predetermined size commensurate with a desired flow rate. Therefore, a consumer drinking from the spout 34 will not sense any appreciable variation of flow rate, which might cause discomfort or indigestion.

The bag 3 is supported within the container 2 from a plastic fitment or spout 4 which is, in turn, secured to the outer tubular housing 1 of the flow-rate control device. Appropriate O-ring seals 19 and 20 are provided around the exterior of the tubular housing 1 in order to preclude the flow of fluid between the bag spout or the retainer 24, respectively. A spacer 26 with a baffle portion 37 is provided between retainer 24 and the upper portions of the bag 3 and spout 4 to keep the main portion of the bag disposed below and spaced from the openings 1A, regardless of the volume of pre-mix contained in the bag. A baffle 38 with ports 38A is also provided at the bottom of container 2 to keep bag 3 from breaking on plug 13.

Openings 1A should be sized so that bag 2 will not collapse into and break on the edge thereof. In an alternative embodiment, openings 1A may have plugs therein containing a plurality of spaced small apertures.

The dispensing valve of the present invention is formed by an O-ring 21 at the end of a plunger 25, which seats against the inside surface of the drinking spout 34 adjacent the outlet opening thereof. Plunger 25 is spring-biased to a normally closed position by a coil spring 7. A valve-actuating lever 28, coupled to the distal end of plunger 25 from the drinking spout 34 through a washer 27 by a snap ring 12, is provided for opening and closing the valve to initiate or stop the flow of beverage from the spout 34. In the position illustrated in FIG. 4, the valve is closed, and the lever 28 is locked in its unactuated position. FIG. 4 also shows, in cross-section, appropriate O-ring seals 22, 17 and 16 spaced along the valve housing about the plunger 25.

Figure 5:
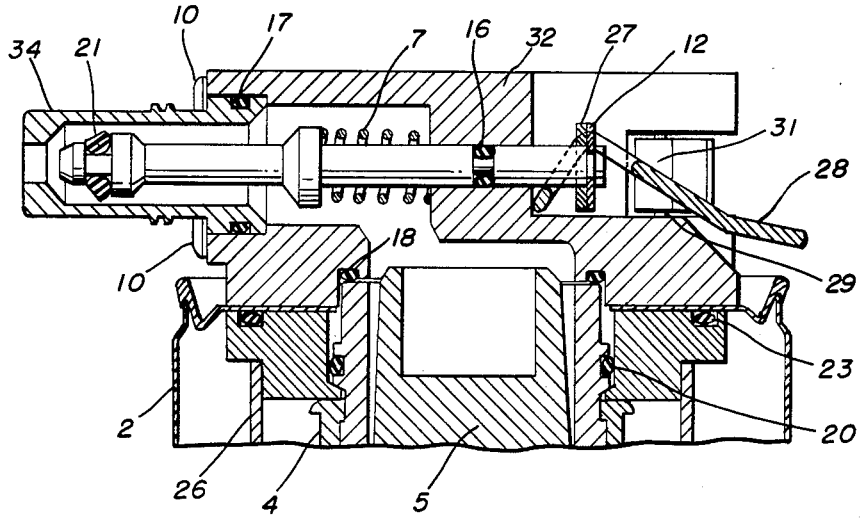
FIG. 5 is a partial section of the micro-gravity pre-mix package of the present invention taken along line 4—4 of FIG. 3, illustrating the dispensing valve and valve actuating lever in an open and actuated condition.

FIG. 5 is a partial, sectional view illustrating the valve element 21 of the dispensing valve of the present invention in an open position, and lever 28 in a depressed, actuated or unlocked position. In the position illustrated in FIG. 5, carbonated beverage pre-mix will flow from bag 3 through openings 1A, the space or passage FP between flow control elements 5 and tubular housing 1 and out through the drinking spout 34.

Figure 6:
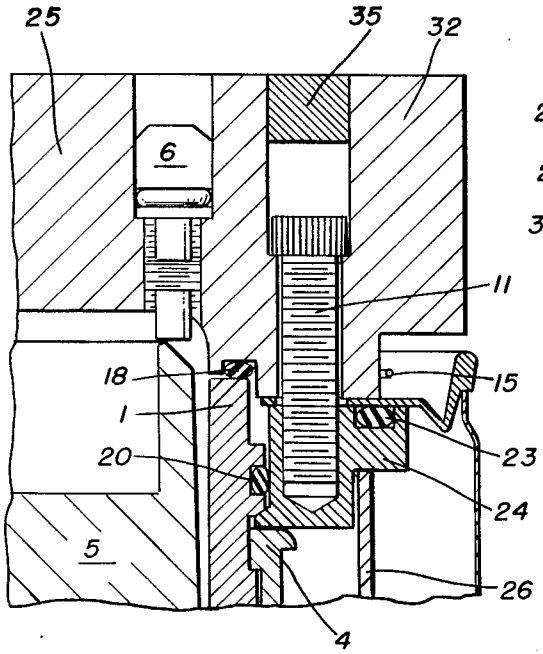
FIG. 6 is a partial sectional view of the package of the present invention, taken along line 6—6 of FIG. 3, illustrating how the flow-rate control device of the present invention is manually adjustable.

Referring to FIG. 6, there is illustrated in cross-section a manually-adjusting means or screw 6 for adjusting the initial position or static position of the bullet-shaped flow control element 5 to achieve a low flow rate, such as illustrated by the relative positions of elements in FIG. 7A; or a high flow rate such as illustrated by the relative positions of the components illustrated in FIG. 7B. As illustrated in FIG. 6, the flow rate may be adjusted by changing the vertical position of the bullet-shaped flow control element 5 by changing the vertical position of the flow adjuster screw 6. As clearly illustrated in FIGS. 7A and 7B, a high or low flow rate can be provided in this manner since the vertical position of bullet-shaped flow control element 5 changes the size of the flow passage FP.

A preferred flow rate from spout 34 is 5 mils/second (300 c.c./minute). A preferred pressure at spout 34 is 1 to 1.5 p.s.i. The pre-mix pressure in bag 3 is preferably 60 p.s.i. Therefore, flow control element 5 should be adjusted by screw 6 to attain these preferred pressures and flow rates at spout 34.

Other details illustrated in FIG. 6 are retaining screws 11 and the associated cosmetic plugs 35.

Accordingly, it can be seen from the detailed description of FIGS. 1 to 7 that the micro-gravity pre-mix package of the present invention may be operated in substantially the following manner. One would first remove the safety cap 33 from the drinking spout 34. The safety lock 31 would then be pivoted out from underneath the valve-actuating lever 28 to the unlocked position. The astronaut would then place the drinking spout or nozzle in his or her mouth and press the valve-actuation lever 28 all of the way down, opening the valve within spout 34 and dispensing the carbonated beverage pre-mix directly into his or her mouth. The flow rate would be pre-set by the manually-adjustable flow adjuster screw 6, to attain the aforementioned preferred conditions to assure the comfort of the particular astronaut. The position of the manual flow rate adjuster 6 ensures that the beverage passing through the drinking spout 34 will flow at a substantially constant and comfortable flow rate into the astronaut's mouth.

The container 2, for use with the present invention, may be manufactured from metal, such as aluminum or rigid, high-impact plastic such as polycarbonate, nylon or the like. Container 2 may be a 12 oz. can, 2 liter bottle or a larger 2 to 5 gallon container.

The collapsible bag 3 utilized with the package of the present invention may be fabricated from polyethylene, PET or a laminate of metalized polyethylene.

It should be understood that the micro-gravity, pre-mix package of the present invention may be modified as would occur to one of ordinary skill in the art without departing from the spirit and scope of the present invention.

What is claimed is:

1. A package for dispensing a carbonated beverage pre-mix at a controlled rate of flow directly into a consumer's mouth in the micro-gravity conditions of outer space comprising:

(a) a rigid container;

(b) a collapsible bag disposed within the rigid container, said bag containing the carbonated beverage pre-mix;

(c) a drinking spout for dispensing said carbonated beverage directly into the consumer's mouth;

(d) a valve associated with said spout for starting or stopping the flow of carbonated beverage therethrough;

(e) valve actuator means for opening or closing said valve to start or stop said flow, respectively;

(f) propellant gas means disposed in said rigid container around said collapsible bag for compressing said bag and forcing said carbonated pre-mix to flow through said spout when said valve is open, said propellant gas means having a sufficient initial pressure to ensure that the carbonation of said carbonated beverage pre-mix remains in solution throughout a dispensing period of the package; and (g) flow-rate control means for maintaining a substantially constant rate of flow of the carbonated beverage pre-mix from said bag through said drinking spout;

said flow rate control means includes a tubular housing providing fluid communication between an opening in said bag and said valve, a flow control element within said tubular housing, means for spacing the outer walls of said flow control element from the inner walls of the tubular housing, the space therebetween providing a variable size passage for the flow of the carbonated beverage.

2. The package of claim 1, wherein said tubular housing has a cylindrical top portion and a cone-shaped bottom portion, said flow control element having similarly shaped, opposed cylindrical and cone-shaped surfaces, and further including a coil spring disposed between the opposed apices of the respective cone-shaped surfaces.

3. The package of claim 2, wherein there is further provided means for manually adjusting the initial size of the variable size passage when said valve is closed by moving said flow control element relative to said tubular housing.

4. The package of claim 1, wherein there is further provided means for manually adjusting the initial size of the variable size passage when said valve is closed by moving said flow control element relative to said tubular housing.

5. The package of claim 1, wherein said tubular housing is disposed within said rigid container and extends down into said collapsible bag, said tubular housing having inlet means at the bottom thereof to accommodate the flow of said carbonated beverage pre-mix into said variable size passage.

6. A package for dispensing a carbonated beverage pre-mix at a controlled rate of flow directly into a consumer's mouth in the micro-gravity conditions of outer space comprising:

(a) a rigid container;

(b) a collapsible bag disposed within the rigid container, said bag containing the carbonated beverage pre-mix;

(c) a drinking spout for dispensing said carbonated beverage directly into the consumer's mouth;

(d) a valve associated with said spout for starting or stopping the flow of carbonated beverage therethrough;

(e) valve actuator means for opening or closing said valve to start or stop said flow, respectively;

(f) propellant gas means disposed in said rigid container around said collapsible bag for compressing said bag and forcing said carbonated pre-mix to flow through said spout when said valve is open, said propellant gas means having a sufficient initial pressure to ensure that the carbonation of said carbonated beverage pre-mix remains in solution throughout a dispensing period of the package; and (g) flow-rate control means for maintaining a substantially constant rate of flow of the carbonated beverage pre-mix from said bag through said drinking spout, said flow rate control means including a tubular housing extending into said bag with an inlet opening, permitting fluid in said bag to enter said valve, a flow control element within said tubular housing, adjustment means for spacing the outer walls of said flow control element from the inner walls of the tubular housing, the space therebetween providing a variable size passage for the flow of the carbonated beverage, said tubular housing having a cylindrical top portion and a cone-shaped bottom portion, said flow control element having similarly shaped, opposed cylindrical and cone-shaped surfaces, and further including a coil spring disposed between the opposed apices of the respective cone-shaped surfaces.

7. The package of claim 6, wherein said valve actuator means has safety lock means for precluding the accidental actuation thereof.

8. The package of claim 6, wherein said propellant gas means is pressurized carbon dioxide.

9. The package of claim 6, wherien said drinking spout has a manually removable safety cap associated therewith.

10. The package of claim 9, wherein said safety cap is permanently secured to said package by a cord means.

11. A method for dispensing a carbonated beverage pre-mix at a controlled rate of flow directly into a consumer's mouth in the micro-gravity conditions of outer space comprising the steps of:

(a) providing a package for containing the pre-mix beverage and dispensing the beverage into the consumer's mouth, said package including, 1. a rigid outer container;
2. a collapsible bag containing said carbonated beverage pre-mix, and
3. a spout;

(b) providing a gas under pressure in said package to press the walls of the bag against the pre-mix, the pressure of said gas being sufficient to maintain the carbonation of the pre-mix solution; and (c) dispensing the pre-mix at a controlled rate of flow from the spout into the consumer's mouth;

said dispensing of the pre-mix at a controlled rate of flow is achieved by passing the pre-mix through a passage located immediately upstream from said spout and defined by a cone-shaped dip tube extending into the bag and a bullet-shaped flow control element within said dip tube, the passage being formed by the outer walls of the flow control element being spaced a predetermined distance from the inner walls of the dip tube, said distance controlling the rate of flow of the pre-mix through said spout.

* * * * *